US010563359B2

(12) United States Patent
Czintos

(10) Patent No.: US 10,563,359 B2
(45) Date of Patent: Feb. 18, 2020

(54) CONCRETE BASED REINFORCED ROAD STRUCTURE COVERED BY ASPHALT

(71) Applicant: NOVONOVON Zrt., Kecskemét (HU)

(72) Inventor: Csongor Czintos, Kecskemét (HU)

(73) Assignee: NOVONOVON ZRT., Kecskemet (HU)

( * ) Notice: Subject to any disclaimer, the term of this patent is extended or adjusted under 35 U.S.C. 154(b) by 0 days.

(21) Appl. No.: 16/337,132

(22) PCT Filed: Sep. 25, 2017

(86) PCT No.: PCT/HU2017/050041
§ 371 (c)(1),
(2) Date: Mar. 27, 2019

(87) PCT Pub. No.: WO2018/060751
PCT Pub. Date: Apr. 5, 2018

(65) Prior Publication Data

US 2019/0226157 A1 Jul. 25, 2019

(30) Foreign Application Priority Data

Sep. 28, 2016 (HU) ..... 1600554

(51) Int. Cl.
*E01C 7/14* (2006.01)
*E01C 7/32* (2006.01)
*E01C 7/18* (2006.01)

(52) U.S. Cl.
CPC ..... *E01C 7/325* (2013.01); *E01C 7/145* (2013.01); *E01C 7/185* (2013.01); *E01C 2201/167* (2013.01)

(58) Field of Classification Search
CPC ..... E01C 7/145; E01C 7/185; E01C 7/325; E01C 2201/00

(Continued)

(56) References Cited

U.S. PATENT DOCUMENTS 1,983,412 A * 12/1934 Smith ..... B21D 47/005 52/670
1,994,930 A * 3/1935 Tommerup ..... E01C 9/001 404/134

(Continued)

FOREIGN PATENT DOCUMENTS

CN 101109168 A 1/2008
CN 102418309 A 4/2012
CN 204662194 U 9/2015

OTHER PUBLICATIONS

International Search Report for PCT/HU2017/050041, dated Jan. 16, 2018 (4 pages).

(Continued)

*Primary Examiner* — Raymond W Addie
(74) *Attorney, Agent, or Firm* — Fitch, Even, Tabin & Flannery, LLP

(57) ABSTRACT

Concrete based reinforced road structure covered by asphalt that comprises a basic layer (1) made of concrete with a substantially horizontal upper surface and placed directly or through a subconstruction on the ground and at least one mould cover layer (2) thereon made of asphalt, and support elements (3) positioned between the basic layer (1) and the cover layer (2), wherein the support elements (3) are inserted in a predetermined depth in the basic layer (1) prior to the setting thereof so that they are partially projecting out of the basic layer (1) in normal direction to the upper surface, and the projecting portion provides protection to the cover layer (2) against being displaced relative to the basic layer (1) under loads to which the road is exposed, and the support elements (3) are flat stripes with walls being substantially normal to the surface of the basic layer (1) and comprising subsequent sections with differing directions to form respective meandering lines.

14 Claims, 2 Drawing Sheets

(58) Field of Classification Search
USPC ..... 404/17–31, 134
See application file for complete search history.

(56) References Cited

U.S. PATENT DOCUMENTS 2,912,910 A * 11/1959 Wilson ..... E01C 9/10 404/36
3,033,086 A * 5/1962 Marsden ..... E01C 11/16 404/134
3,870,422 A * 3/1975 Medico, Jr. ..... E01C 3/00 404/31
3,909,144 A * 9/1975 Garn ..... B32B 27/00 404/31
4,142,821 A * 3/1979 Doring ..... E02B 3/126 405/302.4
4,594,022 A * 6/1986 Jeppson ..... E01C 7/187 404/28
4,856,930 A 8/1989 Denning
4,909,662 A * 3/1990 Baker ..... E01C 7/145 264/31
5,009,543 A 4/1991 Ahmad et al.
5,123,778 A * 6/1992 Bohnhoff ..... E01C 11/165 404/28
5,249,883 A 10/1993 Watson et al.
5,749,787 A * 5/1998 Jank ..... A63C 19/04 404/32
7,210,876 B2 * 5/2007 Moralez ..... E01C 9/004 404/36
7,232,276 B2 6/2007 Oka et al.
7,501,174 B2 * 3/2009 Halahmi ..... B29C 48/11 428/131
7,815,395 B1 * 10/2010 Blackwood ..... E03F 1/002 405/43
2008/0152436 A1 6/2008 Torres Vila
2013/0101349 A1 * 4/2013 Wayne ..... B32B 3/266 404/31

OTHER PUBLICATIONS

Written Opinion of the International Searching Authority, dated Jan. 16, 2018 (5 pages).

* cited by examiner

CONCRETE BASED REINFORCED ROAD STRUCTURE COVERED BY ASPHALT

CROSS-REFERENCE TO RELATED APPLICATIONS

This application is a U.S. national phase application filed under 35 U.S.C. § 371 of International Application No. PCT/HU2017/050041,filed Sep. 25, 2017, designating the United States, which claims priority from Hungarian Patent Application No. P1600554, filed Sep. 28, 2016, the complete disclosures of all the applications are hereby incorporated herein by reference in their entirety.

The invention relates to a concrete based reinforced road structure covered by asphalt that comprises a basic layer made of concrete with a substantially horizontal upper surface and placed directly or through a subconstruction on the ground and at least one mould cover layer thereon made of asphalt, and support elements positioned between the basic layer and the cover layer. This structure is capable of preventing or decreasing deformations in the asphalt layer under thermal effects and load coming from traffic.

Most versions of load bearing roads comprise several layers wherein the lower layer comprises at least one concrete base designed to resist the load and this is covered by one or more mould asphalt layer.

The asphalt layer that comprises elastic bitumen as binding material has physical and mechanical properties which substantially change within the temperature range characteristic to the temperate global zone. Because during the sudden temperature changes in summer owing to the fast relaxation of asphalt and the distribution of the generated tensions in all directions no substantial thermal pressure or pulling tensions will take peace. The typical result will be the rutting or cave-ins of the pavement caused by the load of tires of heavy commercial vehicles i.e. by the uneven compression of the asphalt. In case of sudden drops of the temperature in winter the damages of the asphalt come from thermal cracks.

In addition to thermal and mechanical pressure loads the road is also exposed to bending loads coming from the through going traffic. This load component depends also on the thermal effects. Owing to the changing mechanical properties of the asphalt with time the bending type load will be the greater when the layers that constitute the road structure cannot cooperate because bending and pulling tensions can emerge therein which might be greater than the tension strength of the material of the given layer against pulling.

One way of designing pavements to these three kinds of loads is the choosing of appropriate materials and the use of structural solutions that prevent the road from the consequences of these effects.

The main reason of the aforementioned triple problems lies in that there is no appropriately strong binding between the base layer made of concrete that has the task of receiving and resisting the load and the asphalt cover layer thereon therefore in most of the cases the asphalt layer gets displaced on the concrete or being cracked without displacement.

In U.S. Pat. No. 7,232,276 B2 a road structure is described provided with a reinforcement layer, wherein under the usually applied upper asphalt layer a separate reinforcement layer is placed which comprises in a sandwich-like manner two asphalt layers and a binding layer between them made of glass fibers stabilized by a plastic binder. This structure has the drawback that its correct use requires high degree of skill and under temperate climatic environment the plastic bound reinforcement layer will soon get destroyed. A further drawback lies in that this solution cannot render the cooperation of the rigid basic layer and the flexible cover layer(s).

In U.S. Pat. No. 5,249,883 a structure composed of four layers of asphalt and aggregate is disclosed, wherein a metal sheet is placed under the structure. In this case the loadability of this road is good and the four layers cooperate properly because of the use of modified elastomers, however, it has only a narrow field of use owing to the sophisticated and expensive technology, therefore it is mainly used on bridges and in garage buildings. When used on bridges the high traffic and the increased load because of the high speed of the vehicles the cohesion between the metal sheet and the asphalt layers can be insufficient and this cooperation is adversely influenced by the high difference in the thermal conductivity of these layers.

In U.S. Pat. No. 5,009,543 an asphalt correction method is disclosed for heavily worn roads with caves and/or rutting. Here a grid structure is built in the asphalt which has e.g. a honeycomb shape which has a strong withholding effect, whereby durable corrections can be made. A drawback of this solution is that there is no load bearing solid support layer under the asphalt and the grid structure is fully embedded in the asphalt layer, therefore it cannot solve the aforementioned problem i.e. the displacement between the concrete base and the asphalt cover layer thereon.

In the document US 2008/0152436 A1 a reinforcement structure is described that is built in the asphalt layer by zigzagged straps combined to form closed shapes. The publication describes several ways of such reinforcement structures but these are all placed prior to the moulding of the asphalt layer on the underlying support surface (constituted mainly by the ground), therefore the grid structure can reinforce the asphalt layer only but has no effect on the quality of connection between the asphalt layer and the underlying support.

There are several other documents which deal with the connection of a concrete base and the asphalt layer placed thereon including e.g. CN 101109168A, CN 204662194 U, CN 102418309 A which have the common feature that the upper surface of the concrete base layer is shaped to have a periodic spatial profile (e.g. to have grooves) and in such cases there will be a form fitting connection with the overlying mould asphalt layer that prevents the displacement of the two layers.

A common drawback of such solutions is that the formation of a spatially structured upper surface for the base layer can be provided only by using very big tools and this is an expensive job, and water can collect in the deeper parts of the grooves which when getting frozen causes cracks, furthermore the grooves have generally a single main direction and the protection against displacement is efficient only normal to this direction, although the aforementioned loads can come from any direction.

The object of the present invention is to provide a reinforced road structure that has a concrete base and a mould asphalt layer thereon which can provide and efficient protection against all the three listed deforming load effects and can prevent the asphalt layer(s) from being displaced relative to the concrete base layer.

This objective has been reached by providing a concrete based reinforced road structure covered by asphalt that comprises a basic layer made of concrete with a substantially horizontal upper surface and placed directly or through a subconstruction on the ground and at least one mould cover layer thereon made of asphalt, and support elements positioned between the basic layer and the cover layer, and according to the invention the support elements are inserted in a predetermined depth in the basic layer prior to the setting thereof so that they are partially projecting out of the basic layer in normal direction to the upper surface, and the projecting portion provides protection to the cover layer against being displaced relative to the basic layer under loads to which the road is exposed, and the support elements are flat stripes with walls being substantially normal to the surface of the basic layer and comprising subsequent sections with differing directions to form respective meandering lines.

It is preferred if the meandering stripes formed of the support elements are extending beside each other so that along certain sections they are interconnected to form together an array of closed shapes.

The positioning will become easier if respective openings are provided in the support elements that extend till the upper surface of the basic layer and at the lower edges of the openings respective cut tabs are folded out to prevent the support elements from immersing in the material of the basic layer when it is still in a pasty state.

It is preferred if the closed shape is triangle, square, circle or hexagon.

In a preferred embodiment the cover layer comprises gravel pieces made of stone, and the support elements extend out from the upper surface of the basic layer at least as high as the half of the average size of said gravel pieces.

For the sake of easier handling it is preferred if the upper sides of the support elements have a wider upper rim, and it is more preferred if such wider rims are provided also on their lower edges.

It is also preferred if that the support elements are arranged beside each other to form respective regular shapes which are connected to each other.

The invention will now be described in connection with preferable embodiments thereof, in which reference will be made to the accompanying drawings. In the drawing.

Figure 1:
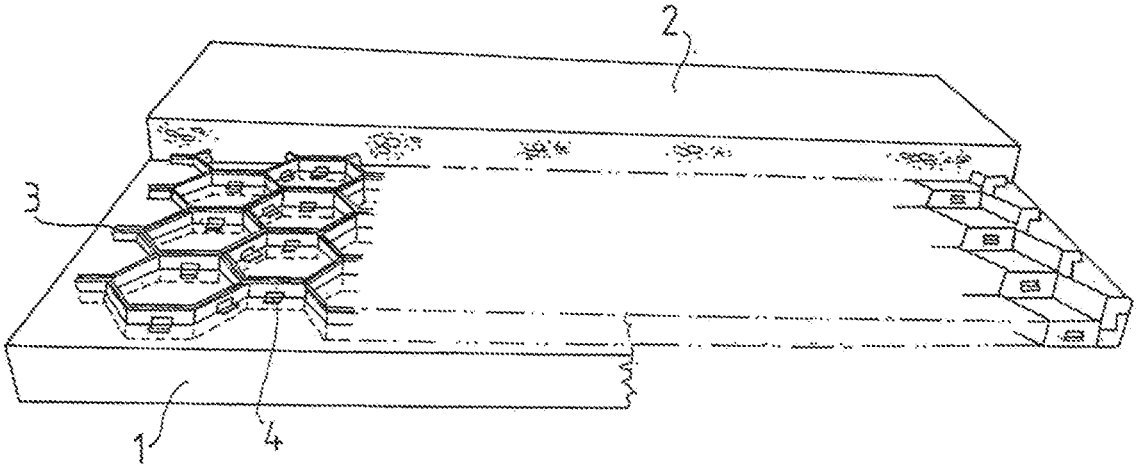
FIG. 1 shows a preferred embodiment of the road structure according to the invention in half ready state in a stepped section.

FIG. 1 shows the simplified stepped sectional view of the first embodiment of the road structure according to the invention in which at the bottom a solid basic layer 1 is arranged made of concrete. Below the basic layer 1 the ground is prepared for instance by compaction or with a different way or there can be a coarser grained concrete. The basic layer 1 has a design which can take and resist taking static and dynamic loads typically present at the road under construction, and the basic layer 1 has preferably a planar or slightly bowed upper surface which is preferred for leading water away and for its much cheaper manufacture as if it was an articulated structure. The basic layer 1 is preferably strengthened by a steel reinforcement which need not be indicated separately as it is not required for understanding the present invention.

When the road is constructed, an asphalt cover layer 2 is provided on the top of the basic layer 1 by moulding. The asphalt layer 2 comprises as shown in the sectional view of FIG. 5 gravel with small pieces of different size and bitumen that fills the gaps between the pieces. In FIG. 1 the cover layer 2 has been shown in a partially removed state for the sake of illustrating the structure prior to the placement of the cover layer 2.

Before the setting of the basic layer 1 support elements 3 are positioned from above which have special shape and layout as illustrated in FIG. 1 in such a way that the support elements 3 extend out from the upper surface of the basic layer 1 in a predetermined height normal to the surface, whereas the support elements 3 are at the same time sunken in a predetermined depth also in the basic layer 1. The support elements 3 are made preferably but not necessarily from iron, steel, or they can be made from a material designed to take the expected load. This task can also be taken by an appropriately chosen plastic material.

Figure 2:
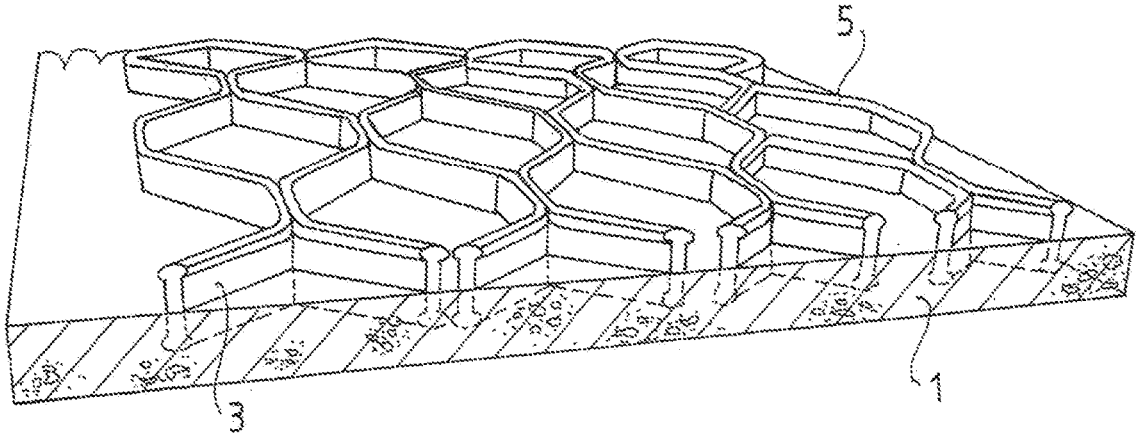
FIG. 2 shows an enlarged detail similar to FIG. 1.

FIG. 2 shows the design of a preferred embodiment of the support elements 3 in an enlarged view, in which the support elements 3 have the shape of stripes formed of half hexagons positioned normal to the surface and arranged opposite to each other and they are connected to each other at their contacting surface areas by means of bolts, rivets or by welding, whereby they constitute a closed arrangement of stable closed polygons e.g. form hexagonal grids that extend out of the surface to a predetermined height. This design is preferred because the closed polygons are interconnected with force fitting attachments, whereby they can resist forces coming from any direction that act on the cover layer 2 mould later thereon, whereby they prevent any displacement of the asphalt.

In FIG. 1 it is illustrated schematically that the support elements 3 comprise respective openings made close to the height of the upper surface of the basic layer 1 which have been cut out of the material of the support elements 3 and bent outwardly relative to the original plane of the stripes (which plane is now vertical) to form tabs 4 that provide increased horizontal surfaces that prevent the support element 3 from being immersed in the material of the basic layer 1 when it is still in pasty state. The presence of the tabs 4 and the associated opening is also preferred because in this way in spite of the presence of the support elements 3 there will be a free flow of water through the openings of the support elements 3, and when the cover layer 2 is mould bitumen can flow in the openings causing a further stabilizing effect for the cover layer 2.

Figure 3:
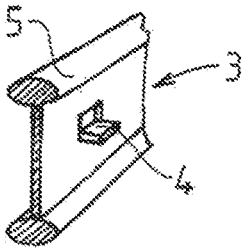
FIG. 3 shows the enlarged cross sectional profile of a preferred embodiment of the support elements 3.

The enlarged detail of FIG. 3 shows that in a preferred embodiment the stripes constituting the support elements 3 have an upper rim 5 with rounded and increased cross section i.e. the stripes do not have sharp edges but upper surfaces with an increased thickness. Such a design is preferable from the point of view of minimizing the hazard of accidents and following the setting of the lower basic layer 1 that fixes the lower portion of the support elements 3 this upper rim 5 makes it possible that prior to the placement of the cover layer 2 vehicles can move on their surface without the danger of their tires being cut by the sharp upper edges of the support elements 3. It is also preferred if the support elements 3 have a symmetric cross section i.e. provided with a similarly wide lower rim 5 as it is shown in FIG. 3 which reinforces their sit in the basic layer 1.

Figure 4:
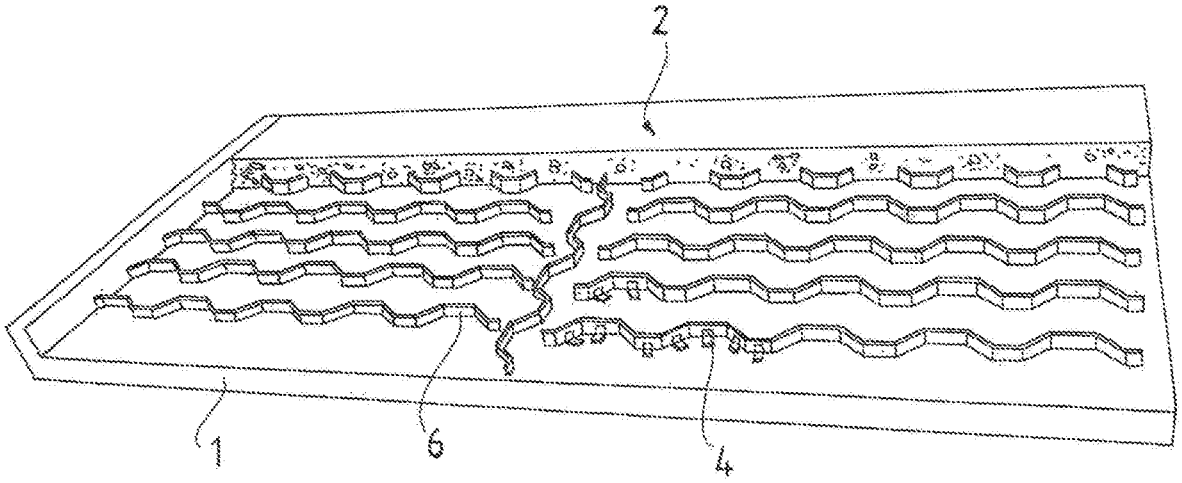
FIG. 4 shows an alternative design of the support elements 3.

FIG. 4 shows stripes 6 (or straps) which constitute the support elements 3 positioned in a spaced arrangement to illustrate that the formation of a closed structure defining holes is not an indispensable condition because the stripes 6 with their meandering lines can be sufficiently stable after the setting of the basic layer 1 in which their lower parts are inserted. In case of roads designed for lower load such an open design can also provide the required stability. If needed, the support elements 3 can also be made as stripes without having the widened rims 5 positioned normal to their plane surfaces in the basic layer 1.

Figure 5:
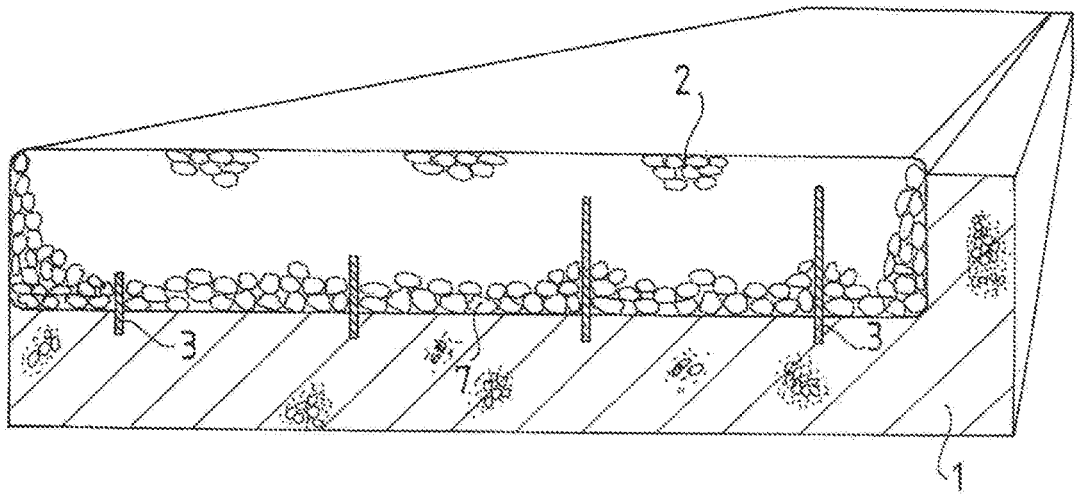
FIG. 5 shows the enlarged cross sectional view of the road structure.

Reference is made now to FIG. 5 showing the cross section of the road after it has been finished. As described earlier following the setting of the basic layer 1 with the support elements 3 previously inserted therein, the cover layer 2 will be positioned from above by moulding in a soft, pasty state. The height of the projection of the support elements 3 above the basic layer 1 is not critical, whereas it is preferred if this height is at least as high as the half of the average size of the stone pieces 7 that constitute the gravel in the cover layer 1 so that the walls of the support elements 3 can provide sufficient resistance against the pressure of these pieces 7. The depth in which the support elements 3 should be inserted in the basic layer 1 can be determined only in the knowledge of the required loadability, but it is also preferred if the depth is at least the half of the average size of the gravel pieces in the basic layer 1. FIG. 5 shows the support elements 3 with different projecting heights. In any given actual embodiment only a single projecting height is chosen.

From the examples shown it can be understood there are several ways for supporting the cover layer 2 made of asphalt, and of these possibilities the choice should be made according to the local conditions at the particular site, to the budget limitations or to other conditions. The essence lies only in that the support elements 3 inserted in and bound to the basic layer 1 stabilize the asphalt cover layer 2 and prevent it from getting displaced even under the simultaneous effect of the previously mentioned three types of load.

The invention claimed is:

1. A reinforced road structure comprising a basic layer made of concrete having a substantially horizontal upper surface and which is placed directly or through a subconstruction while the concrete is in a non-solidified pasty state on the ground, support elements having portions that extend through the upper surface into the concrete at a predetermined depth, the support elements having projecting portions partially projecting out from the basic layer in a direction normal to the upper surface, and the support elements having side walls defined by flat cross sections, the support elements forming a generally serpentine shape along their length, at least one cover layer over the basic layer, the at least one cover layer comprised of asphalt, wherein the projecting portions of the support elements partially projecting out of the basic layer are embedded in and covered by the at least one cover layer, wherein the projecting portions provide protection to the cover layer against being displaced relative to the basic layer when the road structure is under loads to which the road structure is exposed.

2. The reinforced road structure as claimed in claim 1, wherein the support elements extend beside each other and along certain of the flat cross sections the support elements are interconnected to thereby define together an array of closed shapes.

3. The reinforced road structure as claimed in claim 1, wherein the support elements have respective openings that extend till the upper surface of the basic layer, the respective openings having lower edges, and respective fold-out cut tabs at the lower edges so that the support elements have their projecting portions and their portions that extend through the upper surface into the concrete at a predetermined depth.

4. The reinforced road structure as claimed in claim 1, wherein the cover layer comprises gravel pieces made of stone, and the support elements extend out from the upper surface of the basic layer at least as high as the half of the average size of the gravel pieces.

5. The reinforced road structure as claimed in claim 1, wherein the support elements are arranged beside each other to form respective regular shapes which are connected to each other.

6. The reinforced road structure as claimed in claim 2, wherein the closed shapes are selected from the group consisting of triangle, square, circle or hexagon.

7. The reinforced road structure as claimed in claim 2, wherein respective openings are provided in the support elements that extend till the upper surface of the basic layer, the respective openings having lower edges, and respective fold-out cut tabs at the lower edges so that the support elements have their projecting portions and their portions that extend through the upper surface into the concrete at a predetermined depth.

8. The reinforced road structure as claimed in claim 2, wherein the cover layer comprises gravel pieces made of stone, and the support elements extend out from the upper surface of the basic layer at least as high as the half of the average size of the gravel pieces.

9. The reinforced road structure as claimed in claim 3, wherein the closed shapes are selected from the group consisting of triangle, square, circle or hexagon.

10. The reinforced road structure as claimed in claim 1, wherein the support elements are made of iron or steel.

11. A reinforced road structure comprising a basic layer made of concrete having a substantially horizontal upper surface and which is placed directly or through a subconstruction on the ground, support elements extending through the upper surface into the basic layer at a predetermined depth, said support elements having projecting portions that partially project out of the basic layer in normal direction to the upper surface, said support elements comprising flat stripes with walls substantially normal to the upper surface of the basic layer, said flat stripes including sections with differing directions to thereby form respective meandering lines, and said support elements having upper sides with a wider upper rim, at least one cover layer comprised of asphalt over the basic layer, wherein the support elements partially projecting out of the basic layer are embedded in and covered by the at least one cover layer, wherein the projecting portion provides protection to the cover layer against being displaced relative to the basic layer when the road structure is under loads to which the road structure is exposed.

12. A reinforced road surface obtained by forming a basic layer from concrete, while the concrete is in a non-solidified state, directly or through a subconstruction on the ground, the basic layer having a substantially horizontal upper surface, inserting support elements from above through the upper surface into the basic layer at a predetermined depth before the concrete sets, wherein the support elements have projecting portions that partially project out of the basic layer in normal direction to the upper surface, and wherein the support elements comprise flat stripes having walls substantially normal to the surface of the basic layer, and said flat stripes comprising sections having differing directions to thereby form respective meandering lines, forming a hardened basic layer by hardening and setting the concrete, placing at least one cover layer comprised of asphalt placed while in a pasty state over the hardened basic layer, wherein the projecting portions of the support elements are embedded in and covered by the at least one cover layer, wherein the projecting portions provide protection for the cover layer against being displaced relative to the hardened basic layer when the road structure is exposed to loads during use.

13. The reinforced road structure as claimed in claim 11, wherein the support elements are made of iron or steel.

14. The reinforced road structure as claimed in claim 12, wherein the support elements are made of iron or steel.

* * * * *